US006833673B2

(12) United States Patent
Toyoda et al.

(10) Patent No.: US 6,833,673 B2
(45) Date of Patent: Dec. 21, 2004

(54) PLASMA DISPLAY PANEL AND METHOD FOR MANUFACTURING THE SAME

(75) Inventors: Osamu Toyoda, Kawasaki (JP); Motonari Kifune, Kawasaki (JP); Kazunori Inoue, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 10/335,413

(22) Filed: Jan. 3, 2003

(65) Prior Publication Data

US 2003/0173899 A1 Sep. 18, 2003

(30) Foreign Application Priority Data

Mar. 18, 2002 (JP) ..... 2002-074848

(51) Int. Cl.[7] ..... H01J 11/00
(52) U.S. Cl. ..... 313/583; 313/586
(58) Field of Search ..... 313/583, 585–587; 315/169.4; 345/60

(56) References Cited

U.S. PATENT DOCUMENTS 6,525,470 B1 * 2/2003 Amemiya ..... 313/586
6,650,062 B2 * 11/2003 Inoue et al. ..... 315/169.3
2003/0080683 A1 * 5/2003 Inoue et al. ..... 313/586
2003/0197468 A1 * 10/2003 Shibata et al. ..... 313/586

FOREIGN PATENT DOCUMENTS

JP 11297215 A * 10/1999 ..... H01J/11/02
JP 2002184318 A * 6/2002 ..... H01J/11/02

* cited by examiner

*Primary Examiner*—Vip Patel
*Assistant Examiner*—Glenn D. Zimmerman
(74) *Attorney, Agent, or Firm*—Staas & Halsey LLP

(57) ABSTRACT

A plasma display panel is provided which has a novel cell structure excelling in light emission efficiency. Each display electrode arranged on a first substrate making a substrate pair is formed in a manner to have a three-dimensional structure including an elongated power supplying portion stretching over plural cells aligned in one direction, and discharge portions protruding from the power supplying portion in the direction of electrode arrangement for each cell so as to be close to a second substrate.

12 Claims, 8 Drawing Sheets

PLASMA DISPLAY PANEL AND METHOD FOR MANUFACTURING THE SAME

BACKGROUND OF THE INVENTION

1. Field of the Invention

The present invention relates to a plasma display panel (PDP) and a method for manufacturing the PDP.

The PDP has drawn attention as a thin display device with a wide viewing angle. As being in wide use as a HDTV (high-definition television), a high-performance PDP with higher luminance is desired.

2. Description of the Prior Art

A surface discharge type AC plasma display panel is in use as a large screen display device for a television set. The surface discharge type mentioned herein has a three-electrode structure having first display electrodes and second display electrodes to be anodes and cathodes in display discharge for determining light emission quantity of a cell and address electrodes. The first and second display electrodes are arranged in parallel to each other on a front or rear substrate, while the address electrodes are arranged so as to cross the display electrode pairs. There are two types of arrangement of the display electrodes: one is a type in which a pair of display electrodes is arranged for each row in a matrix display; another is a type in which each of the first display electrodes and each of the second display electrodes are arranged alternately at regular intervals. In the latter case, every three display electrodes correspond to two rows and each display electrode except both ends of the arrangement works for a display of neighboring two rows. The surface discharge type allows a fluorescent material layer for a color display to be arranged away from the display electrode pair in the direction of the panel thickness; thus deterioration of the fluorescent material layer due to ion bombardment in the discharge can be reduced. The surface discharge type is suitable for realizing long life of color screen in comparison with an opposed discharge type in which first display electrodes and second display electrodes are separately arranged on a front substrate and a rear substrate.

In the conventional PDP, display electrodes are formed by patterning a conductive thin film formed on a substrate. More specifically, each of the display electrodes is an elongated film conductor and the surface (the discharge surface) thereof is substantially parallel to the substrate surface.

Conventionally, discharge starting voltage of the surface discharge type is higher than that of the opposed discharge type having approximately the same gap length as the surface discharge type; therefore there is a problem that the light emission efficiency is low.

SUMMARY OF THE INVENTION

It is an object of the present invention to provide a PDP having a novel cell structure that excels in light emission efficiency. It is another object of the present invention to provide a method for manufacturing a PDP having a novel cell structure with high productivity.

According to one aspect of the present invention, there is provided a plasma display panel in which each display electrode arranged on a first substrate making a substrate pair is formed in a manner to have a three-dimensional structure including an elongated power supplying portion stretching over plural cells aligned in one direction, and discharge portions protruding from the power supplying portion in the direction of electrode arrangement for each cell so as to be close to a second substrate. Thereby, main surfaces contributing to discharge between the display electrodes are so arranged that each of the main surfaces is approximately orthogonal to the substrate surface and is opposed to the main surface of the neighboring display electrode across a discharge gas space. Under a structure in which the distance between the discharge portions in neighboring display electrodes is shorter than the distance between the power supplying portions, when drive voltage is applied between the neighboring display electrodes, an area where discharge is easy to occur the most in each cell is between the discharge portions opposed to each other. The three-dimensional structure of each of the display electrodes can be attained by a method of forming grooves on the substrate, providing a conductive film to cover the bottom and the side surfaces of the grooves and patterning the conductive film.

The discharge type is classified into opposed discharge between the electrodes across the gas space (however, the direction of charge transfer is not the direction of the panel thickness but the direction along the substrate surface). This discharge type is referred to as "surface direction opposed discharge". Since the main surfaces are opposed to each other in the surface direction opposed discharge, discharge starting voltage is low in comparison with the conventional surface discharge. Additionally, selection of areas of the discharge portions allows discharge current to be optimized; thus light emission efficiency can be enhanced.

DESCRIPTION OF THE PREFERRED EMBODIMENTS

Hereinafter, the present invention will be explained more in detail with reference to embodiments and drawings.

Figure 1:
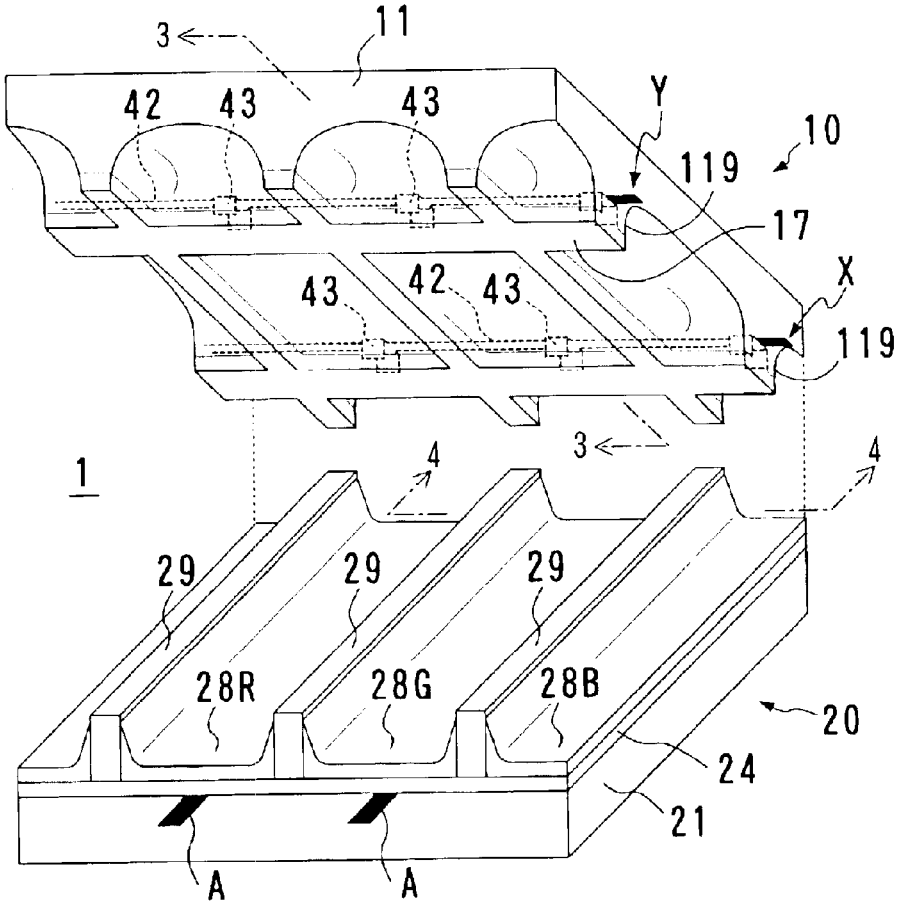
FIG. 1 is a schematic diagram of a cell structure of a PDP according to the present invention.
Figure 2:
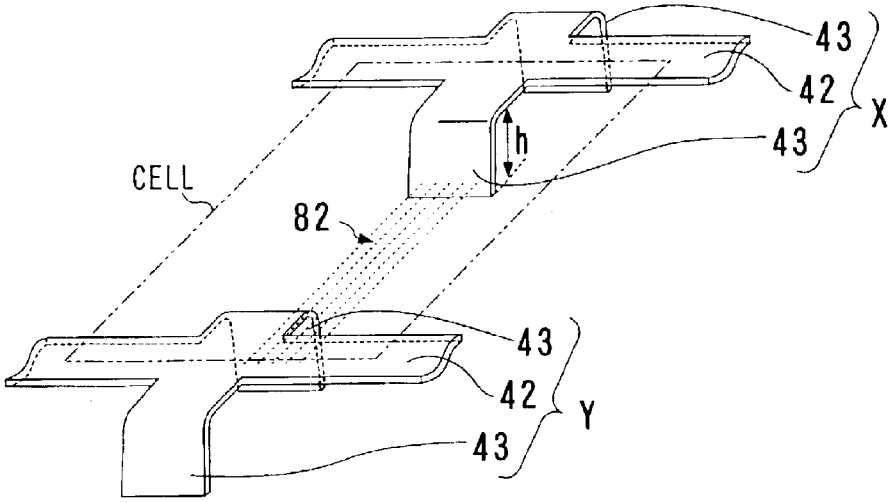
FIG. 2 shows structures of substantial parts in display electrodes.

FIG. 1 is a schematic diagram of a cell structure of a PDP according to the present invention. FIG. 2 shows structures of substantial parts in display electrodes. A Protection film for dielectric is not shown in FIG. 1.

The illustrated PDP 1 is a color display device in which multiple cells are arranged so as to constitute rows and columns of a matrix display, and includes a pair of substrate structures 10 and 20. Each of the substrate structures 10 and 20 is a structure including a substrate 11 or 21 making up of an enclosure and cell elements formed on the inner surface of the substrate 11 or 21. FIG. 1 shows a structure including two columns within one row in a display surface, i.e., two cells, and the vicinity thereof.

The rear substrate structure 20 has a structure similar to that of a known typical surface discharge type PDP. Address electrodes A are arranged on the inner surface of the rear glass substrate 21 in such a manner that one address electrode A corresponds to one column. Partitions 29 that are linear band-like in a plan view are formed on an insulator layer covering the address electrodes A at each boundary between columns. The area between the partitions 29 and the side surfaces thereof are covered with fluorescent material layers 28R, 28G and 28B for a color display. The color arrangement has a repetition pattern of red, green and blue colors in which cells of each column have the same color. One pixel of a display image corresponds to three columns within one row, i.e., three cells. The partition pattern is not limited to the illustrated stripe pattern and may be a mesh pattern in which a gap between substrates is defined for each cell.

The front substrate structure 10 has a structure unique to the present invention. Pits having a quadrangular shape in a plan view are formed on the inner surface of the front glass substrate 11 so that one pit corresponds to one cell; thereby a partition having a grid shape in a plan view is formed to define the gap between the opposed substrates for each cell. The display electrodes X and Y are arranged on upper parts of portions 119 along the row direction in the grid-like partition (called horizontal partitions). One of the neighboring horizontal partitions 119 is provided with the display electrode X and the other is provided with the display electrode Y. The display electrodes X and Y in the entire display surface are so arranged that the display electrodes X and Y are arranged alternately at regular intervals at a rate of three per two rows, and the neighboring electrodes make an electrode pair. The number of rows plus one comes to the total number of display electrodes. The display electrodes X and Y are covered with an insulator 17 that has a grid shape in a plan view and is overlapped with the partition. Portions along the column direction in the partition (called vertical partitions) prevent cross talk due to discharge in the row direction. The vertical partitions, however, can be omitted when there is the minimum possibility of the cross talk or the cross talk can be prevented by drive control.

Each of the display electrodes X and Y is a conductive film including an elongated power supplying portion 42 extending, or stretching, continuously over the entire length of the display surface, in the row direction, and plural discharge portions 43 protruding from the power supplying portion 42 in the direction of the electrode arrangement for each cell. As shown in FIG. 2, each of the discharge portions 43 has an end protruding from the power supplying portion 42 into the rear side in a curve, and has a surface approximately orthogonal to the substrate surface. The orthogonal surface functions as a main surface for discharge. Therefore, the orthogonal surface is hereinafter sometimes referred to as the main surface. The main surface of the display electrode X is opposed to the main surface of the neighboring display electrode Y across a discharge gas space. The conductive film forming the display electrodes X and Y has a thickness of approximately 2 $\mu$m, while the discharge portion 43 has a height (the length of the main surface) h of approximately 50 $\mu$m. The main surfaces are opposed to each other and the distance therebetween is shorter than the distance between the power supplying portions 42. Therefore, application of drive voltage between the neighboring display electrodes leads to generation of surface direction opposed discharge 82 between the discharge portions that are opposed to each other.

Figure 3:
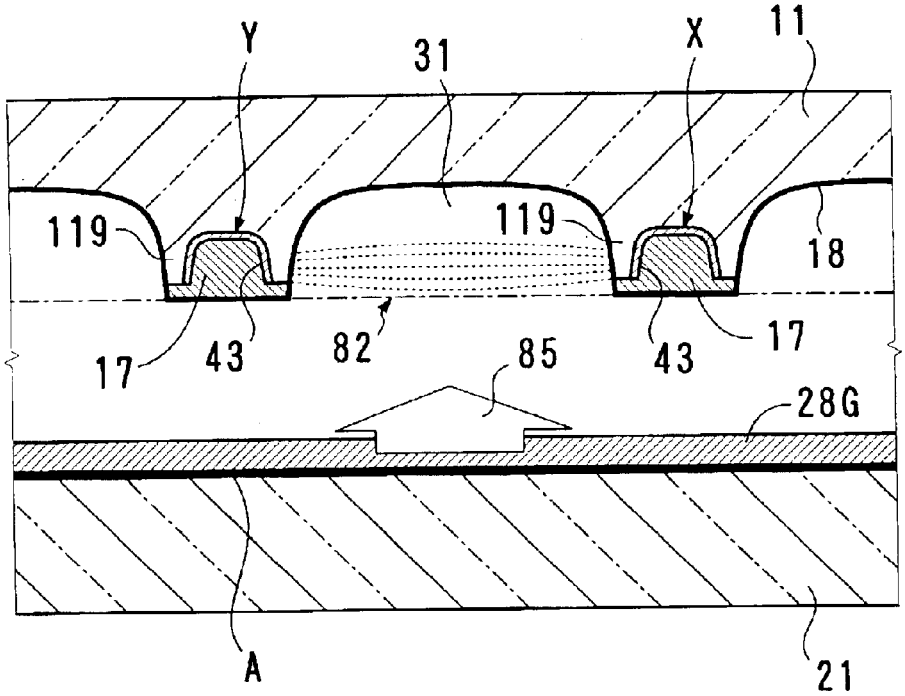
FIG. 3 shows a structure of a cross section taken along the line 3—3 in FIG. 1.
Figure 4:
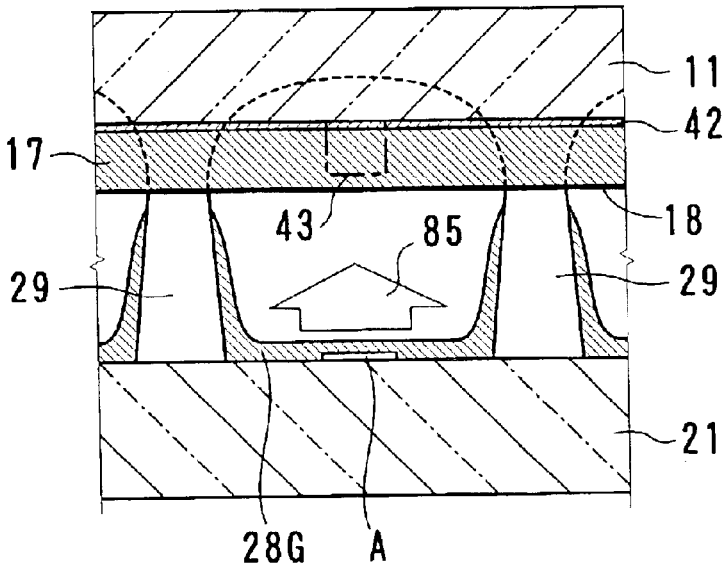
FIG. 4 shows a structure of a cross section taken along the line 4—4 in FIG. 1.

FIG. 3 shows a structure of a cross section taken along the line 3—3 in FIG. 1. FIG. 4 shows a structure of a cross section taken along the line 4—4 in FIG. 1.

As shown in the drawings, the display electrodes X and Y are practically covered with the insulator 17 and a spatter-resistant protection film 18 that is made of magnesia. The insulator 17 is provided, thereby ensuring that discharge between the power supplying portions 42 in the neighboring display electrodes X and Y, and discharge between the power supplying portion 42 and the discharge portion 43 can be inhibited.

As shown in FIG. 4, the discharge portions 43 in the display electrodes X and Y are placed on both ends of a discharge gas space 31 defined by the horizontal partitions 119. The surface direction opposed discharge 82 is generated between the discharge portions 43 and the distance therebetween has a value large enough to be close to the cell size in the column direction; therefore the discharge 82 becomes discharge having a positive column of high luminance. Additionally, since the capacitance between the display electrodes is small, wasteful power for charging the capacitance is little; thereby resulting in improvement in light emission efficiency. The discharge 82 is generated at a position away from the fluorescent material layer (the fluorescent material layer 28G in FIG. 4); therefore the fluorescent material in the PDP 1 is hard to deteriorate similarly to the conventional surface discharge type PDP.

A general drive sequence for a display using the PDP 1 having the structure discussed above is as follows. According to the electrode structure of the PDP 1, each of the display electrodes X and Y except both ends of the arrangement is common to two neighboring rows; therefore interlace drive is carried out in which one frame is divided into a field for displaying data at odd rows and a field for displaying data at even rows. In the address period of each of the fields, the display electrode Y is used as a scan electrode to perform row selection and, at the same time, the address electrode A corresponding to the cells to be lighted in the selected row is biased to selection potential. Thus, address discharge is generated between the display electrode Y and the address electrode A of the cell to be lighted. The similar processing is carried out sequentially with respect to each of the rows so that predetermined quantity of wall charge is formed at the cell to be lighted. In a succeeding display period after the address period, sustaining voltage is applied between the display electrodes X and Y at each of the rows to be the target of the display; thereby the surface direction opposed discharge 82 is generated only at the cells to be lighted with the wall charge. The discharge gas emits ultraviolet rays under the energy of the surface direction opposed discharge. The ultraviolet rays excite the fluorescent material layer 28G so that display light 85 is emitted by the fluorescent material layer 28G.

A process for manufacturing the PDP 1 includes a step of providing each of the glass substrates 11 and 21 with the structure elements mentioned above individually to obtain the substrate structures 10 and 20, a step of placing the substrate structures 10 and 20 opposite each other to seal the periphery thereof and a step of purifying inside the substrate structures 10 and 20 to fill discharge gas therein. The process for manufacturing the substrate structure 10 is described below.

Figure 5A:
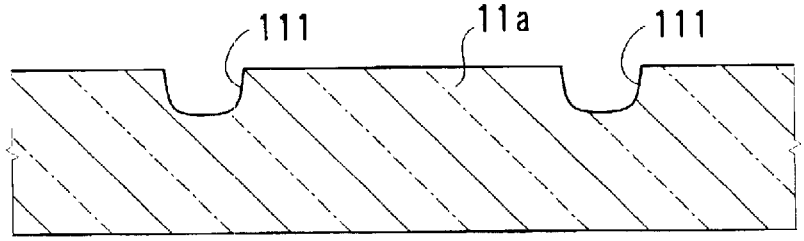
FIGS. 5A–5C are explanatory diagrams of a process for manufacturing a front surface.
Figure 5B:
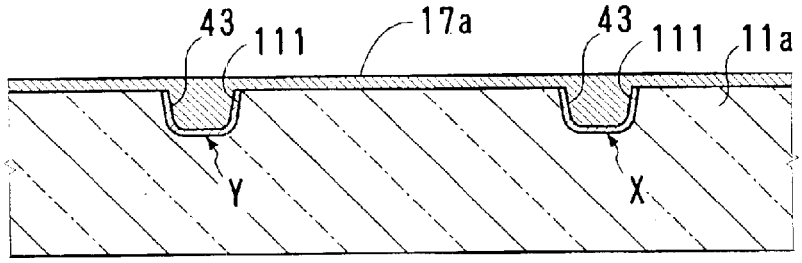
Figure 5C:
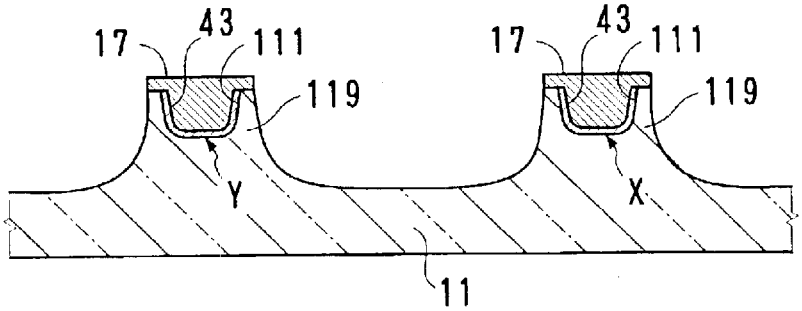

FIGS. 5A–5C are explanatory diagrams of a process for manufacturing the front surface.

As shown in FIG. 5A, a plurality of grooves 111 having a depth of 50 μm is formed on a surface of a plate glass substrate 11*a* at regular intervals, the grooves 111 being required for forming display electrodes with a three-dimensional structure. The sand blasting method is used for forming the grooves. A dry film is used to form a mask with a negative pattern corresponding to the grooves, and then, cutting is carried out. Alumina is suitable as a cutting material.

Next, a conductive material film is formed for covering the grooves 111 and the entire area of the display surface on the glass substrate 11*a* uniformly. As a method for forming such a conductive material film, there is a method of printing a photosensitive thick film material including argentum (Ag) as a main component and a thin-film technique typified by vacuum deposition. A suitable example of a thin film is laminate of chromium (Cr), copper (Cu) and chromium in that order. The conductive material film is patterned by photolithography to form the display electrodes X and Y. Then, low melting point glass paste is coated on the display electrodes X and Y and the entire area of the display surface on the glass substrate 11*a*, and the coating layer is baked to form an insulator layer 17*a* (See FIG. 5B). In the illustrated example, the grooves 111 are filled completely and the surface of the insulator layer 17*a* is flat. However, it is not necessary to fill the grooves 111 completely. As long as each of the display electrodes X and Y is insulated enough, the surface of the insulator layer 17*a* may be dented at the positions of the grooves 111. A method for forming the insulator layer 17*a* is not limited to a thick-film technique and may be another method such as a chemical vapor deposition (CVD) method or a sol-gel method.

Then, portions of arrangement gaps between the display electrodes X and Y in the insulator layer 17*a* and the glass substrate 11*a* are cut more deeply than the grooves 111 using the sand blasting method as shown in FIG. 5C. For example, the glass substrate 11*a* is so cut that each of the horizontal partitions 119 has a height within the range of 100 μm to 150 μm. Alumina is suitable as a cutting material for such cutting. Deep cutting allows the discharge gas space to widen; thereby surface direction opposed discharge is easy to occur, resulting in improvement in light emission efficiency. However, it is essential not to expose the display electrodes X and Y. The cutting is so performed that the glass having a thickness of approximately 30 μm is made to remain between the discharge portion 43 and the discharge gas space as dielectric. Afterward, a protection film is formed, then the step of manufacturing the front surface is completed. Instead of forming the insulator layer 17*a* by baking, it is possible that cutting is carried out at a stage where low melting point paste is dried, and then, the paste is baked for forming the insulator 17.

Figure 6A:
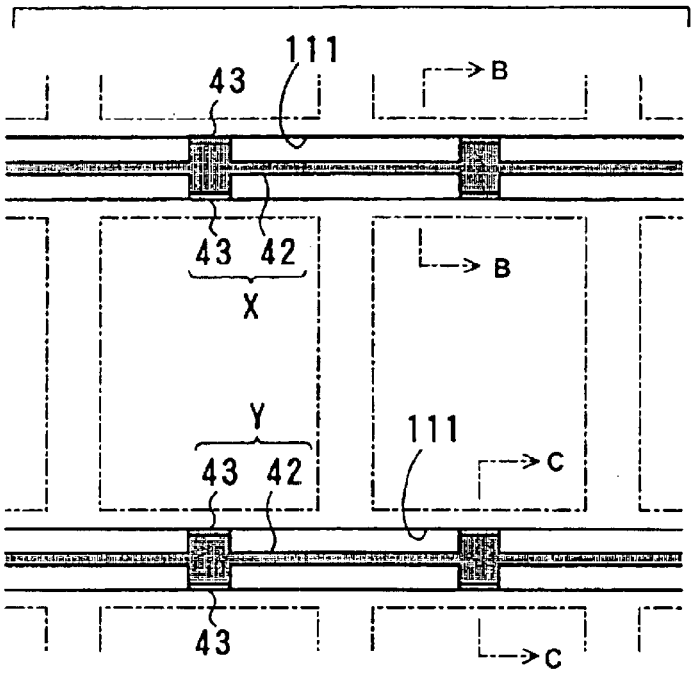
FIGS. 6A–6C show a first example of grooves at each of which a display electrode is located.
Figure 6B:
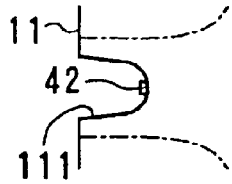
Figure 6C:
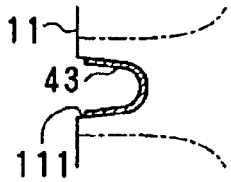
Figure 7A:
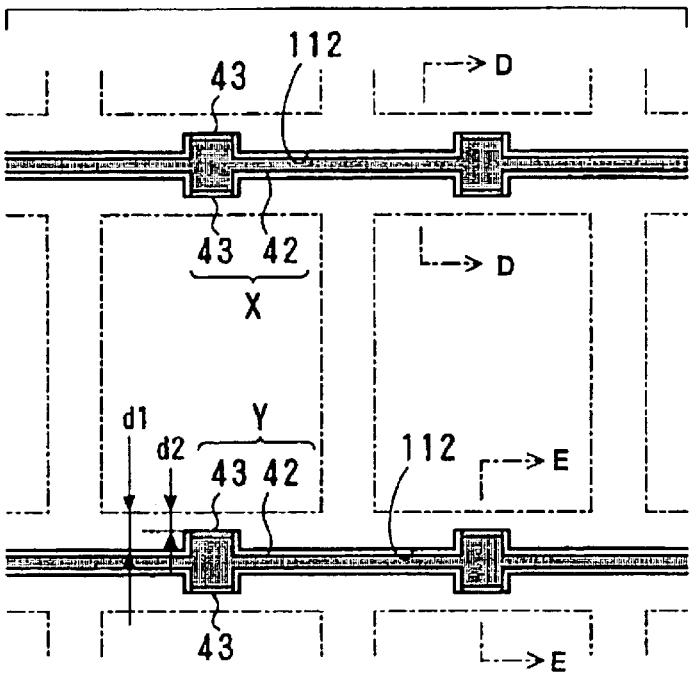
FIGS. 7A–7C show a second example of grooves at each of which a display electrode is located.
Figure 7B:
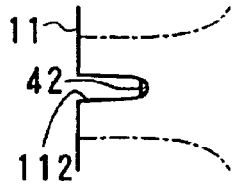
Figure 7C:
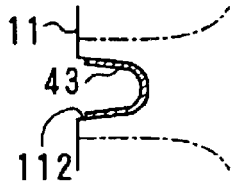

FIGS. 6A–6C show a first example of the grooves at each of which the display electrodes are located. FIG. 6A is a plan view of a grooved structure in accordance with an aspect of the present invention. FIG. 6B is a cross section along line B—B of FIG. 6A and shows a structure of a groove in which a respective display electrode X is positioned. FIG. 6C is a cross section along line C—C of FIG. 6A and shows a structure of a groove in which a respective display electrode Y is positioned. FIGS. 7A–7C show a second example of the grooves at each of which the display electrodes are located. FIG. 7B is a cross section along line D—D of FIG. 7A and shows a structure of a groove in which a respective display electrode X is positioned. FIG. 7C is a cross section along line E—E of FIG. 7A and shows a structure of a groove in which a respective display electrode Y is positioned.

As shown in FIG. 6A, each of the grooves 111 at which the display electrode X or Y is formed is band-like having a constant width in a plan view. This example offers two advantages: first, the grooves 111 are easily formed; second, a high degree of reliability is obtained in patterning of the electrodes. As shown in FIG. 7A, each of the display electrodes X and Y is formed on an inside wall of each of grooves 112 that are substituted for the grooves 111. The plan view form of each of the grooves 112 approximately corresponds to the shape of the display electrodes X and Y including a long band portion extending over the entire length of the row and a short band portion protruding from the long band portion for each cell.

This example offers two following advantages. First, it is possible to use a method of filling the grooves 112 with paste having relatively small viscosity in order to form a conductive material layer. When the paste is dried after the filling, a thin layer is obtained along the wall surfaces of the grooves 112. Secondly, the thickness d1 of the glass intervening between the power supplying portion 42 and the discharge gas space is larger than the thickness d2 of the glass intervening between the discharge portion 43 and the discharge gas space; thereby advantages are offered in insulation and reduction in capacitance. As shown in FIG. 7B, a width of the power supplying portion 42 in the groove 112 is smaller relative to the grooves 112. Therefore, when the conductive film is patterned to form the electrodes, it is desirable to perform oblique exposure or exposure by scattered light in order to ensure that even the bottom of the groove 112 is exposed.

Figure 8A:
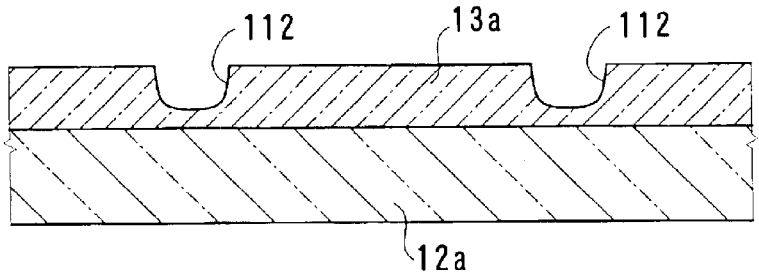
FIGS. 8A–8C are explanatory diagrams of another example of a process for manufacturing a front surface.
Figure 8B:
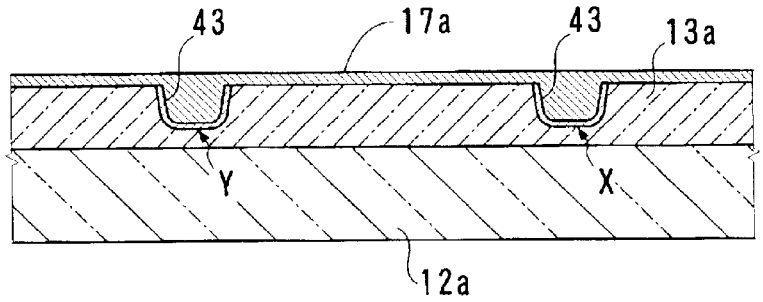
Figure 8C:
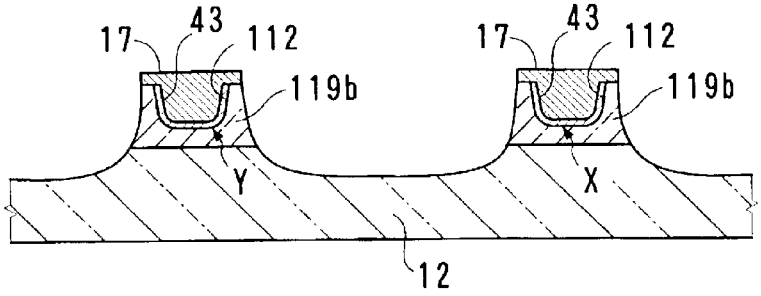

FIGS. 8A–8C are explanatory diagrams of another example of a process for manufacturing the front surface.

As shown in FIG. 8A, low melting point glass paste is coated on an entire area of a display surface on a plate glass substrate 12*a*, and the paste is dried. A dry film is used to provide a cutting mask for forming grooves on the dried paste layer, and then, the sand blasting method is used to cut exposure portions of the paste layer. Calcium carbonate is suitable as a cutting material. The paste layer that was subjected to cutting is baked to form a low melting point glass layer 13*a* with the grooves 112.

Next, similarly to the example shown in FIG. 5B, the display electrodes X and Y and the insulator layer 17*a* are formed (FIG. 8B). Then, portions of arrangement gaps between the display electrodes X and Y in the insulator layer 17*a*, the low melting point glass layer 13*a* and the glass substrate 12*a* are cut more deeply than the grooves 112 using the sand blasting method.

In order to form the low melting point glass layer 13*a* with the grooves 112, there can also be used a well-known technique for forming a partition such as a printing method, an additive process, a photosensitive paste method or a transfer method. Especially, when the transfer method is used, it is possible to form a partition for defining a discharge gas space and grooves to be arranged on the top of the partition simultaneously, thereby eliminating the need to cut a substrate after forming electrodes. Accordingly, the number of manufacturing process is significantly reduced.

Figure 9:
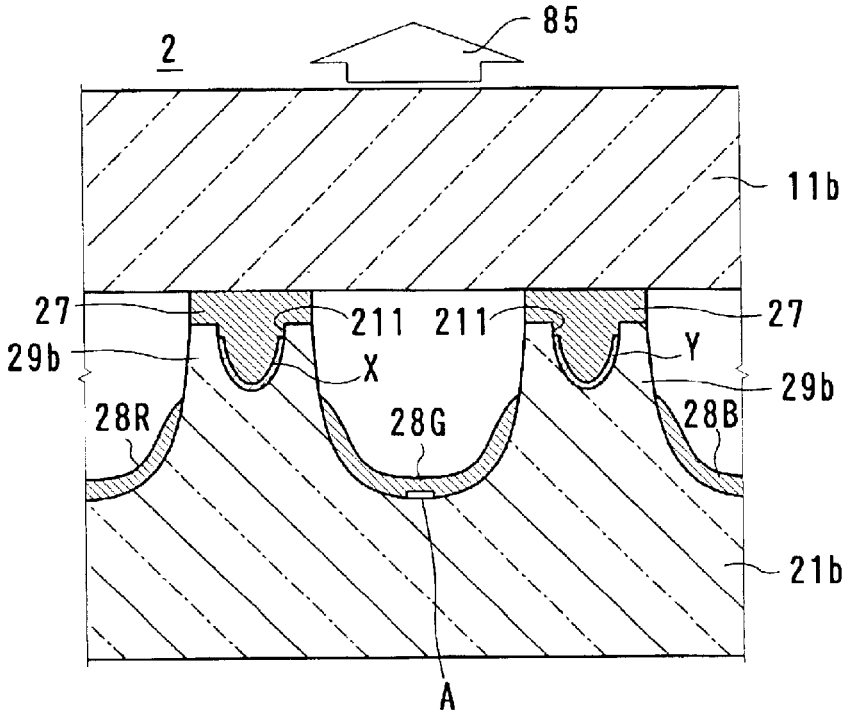
FIG. 9 is a schematic diagram of a cell structure of another PDP.

FIG. 9 is a schematic diagram of a cell structure of another PDP. The PDP 2 has display electrodes X and Y arranged on a rear substrate 21*b*, each of the display electrodes X and Y having a three-dimensional structure similar to the display electrodes shown in FIG. 2. The display electrodes X and Y are formed individually inside a groove 211 on an upper part of a partition 29*b*, and are covered with an insulator 27. Each of the portions of gaps between the electrodes in the substrate 21*b* is provided with a fluorescent material layer 28R, 28G or 28B. It is important that each of the fluorescent material layers 28R, 28G and 28B is arranged in such a manner that the upper ends of the same are not so close to the display electrodes X and Y. Even if screen printing is used to form a fluorescent material layer, printing technique including paste preparation enables a fluorescent material to be arranged properly. The use of photolithography allows a shape of a fluorescent material to be controlled precisely. There are two types of arranging address electrodes A; one is the illustrated type of arranging the address electrodes A on the rear side of the fluorescent material layer. Another is a type of arranging the address electrodes A on a front substrate 11*b*. Additionally, the substrate 11*b* may be provided with a partition for defining a discharge gas space.

In the embodiments discussed above, the sand blasting method is used to form the groove 111 or 112 in which the bottom is smoothly connected to the side surfaces. Thereby, good step coverage of the conductive material film is attained in formation of the display electrodes X and Y; therefore disconnection between the power supplying portion 42 and the discharge portion 43 hardly occurs.

In the embodiments described above, plating is performed only in the power supplying portions 42 in the display electrodes X and Y to laminate conductors; thus conductivity of the display electrodes X and Y can be enhanced.

According to the embodiments described above, compared to a surface discharge type, display discharge is easy to occur so that light emission efficiency is improved. Additionally, areas of main surfaces directly engaging in discharge between the display electrodes are selected so that discharge current can be optimized. Since the gaps between the display electrodes can be larger than those of the surface discharge type, it is possible to make a sufficiently long positive column generate to enhance luminance, and to reduce wasteful power consumption for charging capacitance.

According to the embodiments described above, a PDP having a novel structure can be manufactured.

While the presently preferred embodiments of the present invention have been shown and described, it will be understood that the present invention is not limited thereto, and that various changes and modifications may be made by those skilled in the art without departing from the scope of the invention as set forth in the appended claims.

What is claimed is:

1. A plasma display panel, comprising:

a first substrate and a second substrate opposite to each other and constituting an enclosure;

parallel display electrodes extending in a first direction and arranged on an inner surface of the first substrate, each of the display electrodes being a patterned conductive film and defining corresponding cells, and each comprising:

an elongated power supplying portion extending over the corresponding cells in the first direction, and discharge portions protruding from the power supplying portion in a direction of an electrode arrangement for each of the corresponding cells, wherein each of the discharge portions comprises a three-dimensional structure in which an end of each of the discharge portions protrudes from the power supplying portion toward the second substrate to a position close to the second substrate;

a discharge gas space between the discharge portions of the neighboring display electrodes; and an insulator covering the display electrodes.

2. The plasma display panel according to claim 1, wherein a discharge is most effective between neighboring discharge portions, across the discharge gas space, when a drive voltage is applied between neighboring display electrodes in each of the corresponding cells.

3. The plasma display panel according to claim 1, wherein a distance between the discharge portion and the discharge gas space is shorter than a distance between the power supplying portion and the discharge gas space in each of the display electrodes.

4. A plasma display panel in which cells are arranged so as to constitute rows and columns of a matrix display, comprising:

a pair of substrates opposite to each other and constituting an enclosure;

a partition formed at a boundary position between the rows in the matrix display over an entire length of the rows to narrow a gap between the substrates;

an elongated groove formed on an upper part of the partition extending over the entire length of the rows, a conductive film covering the entire length of a bottom of the groove and partially covering side surfaces of the groove allowing each cell to function as a display electrode; and a discharge gas space between the neighboring display electrodes.

5. The plasma display panel according to claim 4, further comprising:

an insulator covering the display electrode and filling the groove.

6. The plasma display panel according to claim 4, wherein a shape of the display electrode comprises a long band portion extending over the entire length of the row and a short band portion protruding from the long band portion for each of the cells in a plan view.

7. The plasma display panel according to claim 6, wherein a plan view form of the groove corresponds to a form of the display electrode.

8. A plasma display panel, comprising:

a first substrate and a second substrate opposite to each other;

parallel display electrodes extending in a first direction and arranged on an inner surface of the first substrate;

parallel column electrodes formed opposite to and extending in a direction perpendicular to said display electrodes and arranged on the inner surface of the second substrate;

discharge cells, each formed at corresponding intersections of the display electrodes with the column electrodes, wherein each parallel discharge electrode comprises:

an elongated power supplying portion extending over the display electrodes in the first direction, and discharge portions protruding from the power supplying portion in the direction of corresponding column electrodes for each of the cells, wherein each of the discharge portions comprises a three-dimensional structure in which an end of each of the discharge portions protrudes from the power supplying portion toward the second substrate in a curve to a position close to the second substrate; and an insulator covering the display electrodes.

9. The plasma display panel according to claim 8, further comprising:

a discharge gas space between the discharge portions of the neighboring display electrodes, wherein a discharge is most effective between neighboring discharge portions, across the discharge gas space, when a drive voltage is applied between neighboring display electrodes in each of the cells.

10. The plasma display panel according to claim 8, wherein a distance between the discharge portion and the discharge gas space is shorter than a distance between the power supplying portion and the discharge gas space in each of the display electrodes.

11. A plasma display panel in which cells are arranged so as to constitute rows and columns of a matrix display, comprising:

a pair of substrates opposite to each other and constituting an enclosure;

a partition formed at a boundary position between the rows in a matrix display over an entire length of the rows to narrow a gap between the substrates;

an elongated groove formed on an upper part of the partition extending over the entire length of the rows;

a conductive material comprising an elongated power supplying portion covering the entire length of a bottom of the groove and partially covering side surfaces of the groove and plural discharge portions protruding from the power supplying portion to an electrode arrangement direction allowing each cell to function as a display electrode; and a discharge gas space between the discharge portions of the neighboring display electrodes.

12. The plasma display panel according to claim 11, wherein a plan view form of the groove corresponds to a form of the display electrode.

* * * * *

UNITED STATES PATENT AND TRADEMARK OFFICE

CERTIFICATE OF CORRECTION

PATENT NO. : 6,833,673 B2
DATED : December 21, 2004
INVENTOR(S) : Osamu Toyoda et al.

It is certified that error appears in the above-identified patent and that said Letters Patent is hereby corrected as shown below:

Column 8,
Line 23, after "rows" change "," to -- ; --

Signed and Sealed this

Thirty-first Day of May, 2005

JON W. DUDAS
*Director of the United States Patent and Trademark Office*